United States Patent [19]

Hincks et al.

[11] Patent Number: 4,948,173

[45] Date of Patent: Aug. 14, 1990

[54] RECORD KEEPING ASSEMBLY HAVING LOCATING POSTS AND PEEL STRIP

[75] Inventors: Daniel A. Hincks, Burlington; William T. Hincks, Madison; Robert W. Hincks, Farmington, all of Conn.

[73] Assignee: Data Management, Inc., Farmington, Conn.

[21] Appl. No.: 414,521

[22] Filed: Sep. 28, 1989

[51] Int. Cl.[5] ..... B41L 3/00

[52] U.S. Cl. ..... 282/29 B; 283/57; 283/58; 402/80 L; 402/45; 282/DIG. 1; 282/6; 282/27 A; 281/27.1; 281/28; 281/45

[58] Field of Search ..... 281/27.1, 28, 45, 51; 282/DIG. 1, 6, 29 B, 27 A, 27 R; 283/57, 58, 64.1, 117; 402/4, 15, 18, 34, 36, 45, 80 L

[56] References Cited

U.S. PATENT DOCUMENTS

| | | | |
|---|---|---|---|
| 1,154,566 | 9/1915 | Exline | 402/18 |
| 2,060,624 | 11/1936 | Kenedy . | |
| 2,136,186 | 11/1938 | Frost | 283/64.1 |
| 2,394,372 | 3/1945 | Evans . | |
| 2,687,902 | 8/1954 | Becker | 283/64.1 |
| 3,003,502 | 10/1961 | Zalkind . | |
| 3,084,956 | 4/1963 | Nelson | 282/29 B |
| 3,184,255 | 5/1965 | Rohde | 282/29 B |
| 3,324,823 | 10/1965 | Peters . | |
| 3,758,219 | 9/1973 | Stasio et al. | 402/80 L |
| 3,936,201 | 2/1976 | Kenney et al. | 402/4 |
| 4,346,917 | 8/1982 | Clancy | 283/64.1 |
| 4,395,059 | 7/1983 | Russell, III | 282/29 B |
| 4,423,976 | 1/1984 | Feldmahr et al. | 402/80 L |
| 4,465,306 | 8/1984 | Hincks et al. | 281/45 |

*Primary Examiner*—Frank T. Yost
*Assistant Examiner*—Thomas Hamill, Jr.

[57] ABSTRACT

A record keeping assembly has a binder with locating elements spaced along the length of the outer side edge of a panel and a shingled assembly of overlapping elongated sheets with apertures along the one side thereof through which said locating elements extend. Under the shingled assembly is a flexible peel strip which has one end secured to the panel adjacent the outer side and which extends along the locating elements across the panel and projects outwardly therefrom. This peel strip is gripped by its projecting end and lifted upwardly to peel the portion of the shingled assembly overlying the strip from the locating elements.

12 Claims, 4 Drawing Sheets

RECORD KEEPING ASSEMBLY HAVING LOCATING POSTS AND PEEL STRIP

BACKGROUND OF THE INVENTION

The present invention relates to bookkeeping systems using shingled checks and the like, and more particularly to such systems in which there is provided means for lifting the shingled elements or the skeletons thereof from the positioning elements.

One-write bookkeeping systems have become extremely popular since they are an economical means of ensuring accurate entry of data from checks and the like into the permanent record sheets. Generally, one-write systems employ posts or rings along one side of a board or panel onto which is mounted a shingled assembly of checks or the like. A record keeping sheet is disposed under the shingled checks and, as information is entered on a check, it is simultaneously recorded on the underlying record sheet either through a carbon coating upon the check or by chemical interaction between coatings on the opposed faces of the check and recording sheet.

Generally, the shingled check assemblies comprise elongated individual sheets which are firmly bonded together along one side margin and which are provided with apertures to seat upon the locating posts or rings. The individual checks are also scored or perforated along a line adjacent the adhesively engaged apertured portion so that individual checks may be severed along that line and removed from the stack, thus ultimately leaving the adhered skeletal marginal portion.

Because it is highly desirable that the shingled assembly be firmly seated and positioned on the locating rings or posts, the ultimate skeleton remaining thereon is difficult to remove. Generally, the user pries up one end either with a fingernail or a tool, and then grips the small portion beyond the outer post or ring element. Frequently, in the process of lifting the skeleton, it will tear along its length and this requires further efforts to lift another portion sufficiently to grab it for peeling from the posts or rings.

It is an object of the present invention to provide a novel bookkeeping assembly of the type employing a shingled set of sheets mounted upon locating elements, in which there is provided means for readily removing the shingled stack o: its skeleton from the locating elements.

It is also an object to provide such a bookkeeping assembly which is simple and readily assembled from relatively economical and durable parts.

Another object is to provide such an assembly which is easy to use and attractive.

SUMMARY OF THE INVENTION

It has now been found that the foregoing and related objects may be readily attained in a record keeping assembly which includes a base member or binder having a panel with a multiplicity of locating elements spaced along the length of one side thereof. Disposed thereon is a shingled assembly having a series of overlapping elongated sheets, each having a multiplicity of apertures adjacent one side thereof and through which the locating elements extend to mount the assembly on the base member with the sheets extending across the panel. Underneath the shingled assembly is a flexible peel strip having one end secured to the panel adjacent the one side. The peel strip extends across the panel along the locating elements and it has its other end projecting beyond the panel. The peel strip is adapted to be gripped by its projecting end and lifted upwardly to peel the portion of the sheets overlying the strip from the locating elements.

In the preferred embodiment, the peel strip has spaced apertures therein through which the locating elements extend, and it is fabricated from a flexible synthetic resin sheet material. The one end of the peel strip is adhered to the one panel, and the locating elements comprise horizontally oriented rings.

Generally, the base member has at least two panels hingedly connected along the opposite side edge of the first positioned panel, and the assembly additionally includes at least one record keeping page or sheet underlying the shingled assembly and onto which some of the data being recorded on the sheets of the shingled assembly is simultaneously recorded. Generally, the sheets of the shingled assembly comprise checks, and may also comprise receipts, vouchers and the like.

DETAILED DESCRIPTION OF PREFERRED EMBODIMENT OF THE INVENTION

Figure 8:
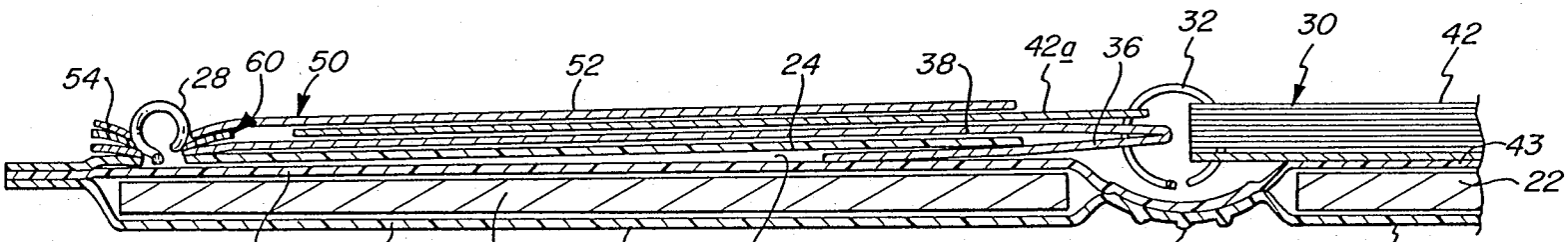
FIG. 8 is a fragmentary sectional view to an enlarged scale along the line 8—8 in FIG. 4 and with a single check of the shingled assembly being positioned on the locating elements.

A one-write bookkeeping assembly embodying the present invention is illustrated in the attached drawings as having a binder or base member generally designated by the numeral 10 and comprised of a pair of panels 12, 14 hinged together along a central web or spine portion 16. As best seen in FIG. 8, the binder 10 is formed from a pair of sheets 18,20 of flexible material which receive a pair of rigid planar members 22 therebetween and which are bonded thereabout to retain them therebetween and provide the panels 12, 14. A top sheet 24 of flexible material is bonded to the inside sheet 18 of the panel 12 to provide a pocket 26 opening adjacent the spine portion 16.

Figure 1:
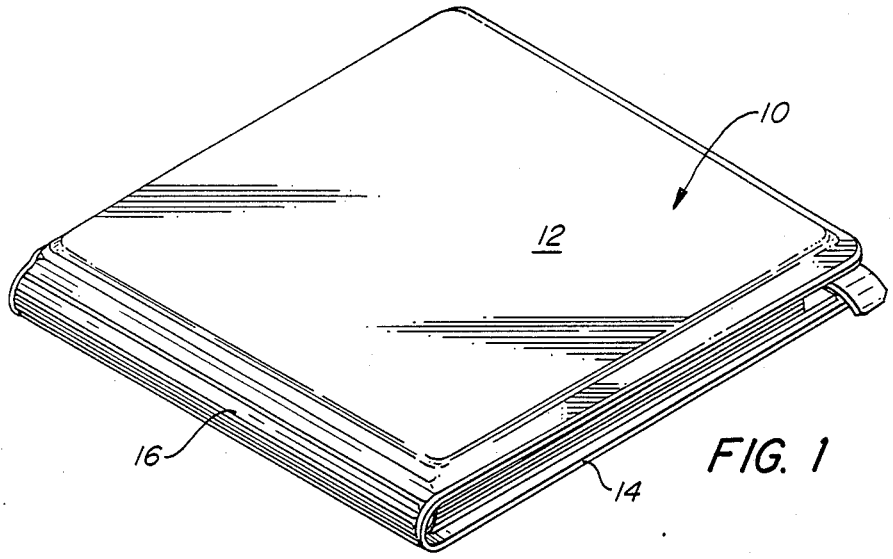
FIG. 1 is a perspective view of a one-write record keeping assembly embodying the present invention with the binder in the closed position.
Figure 2:
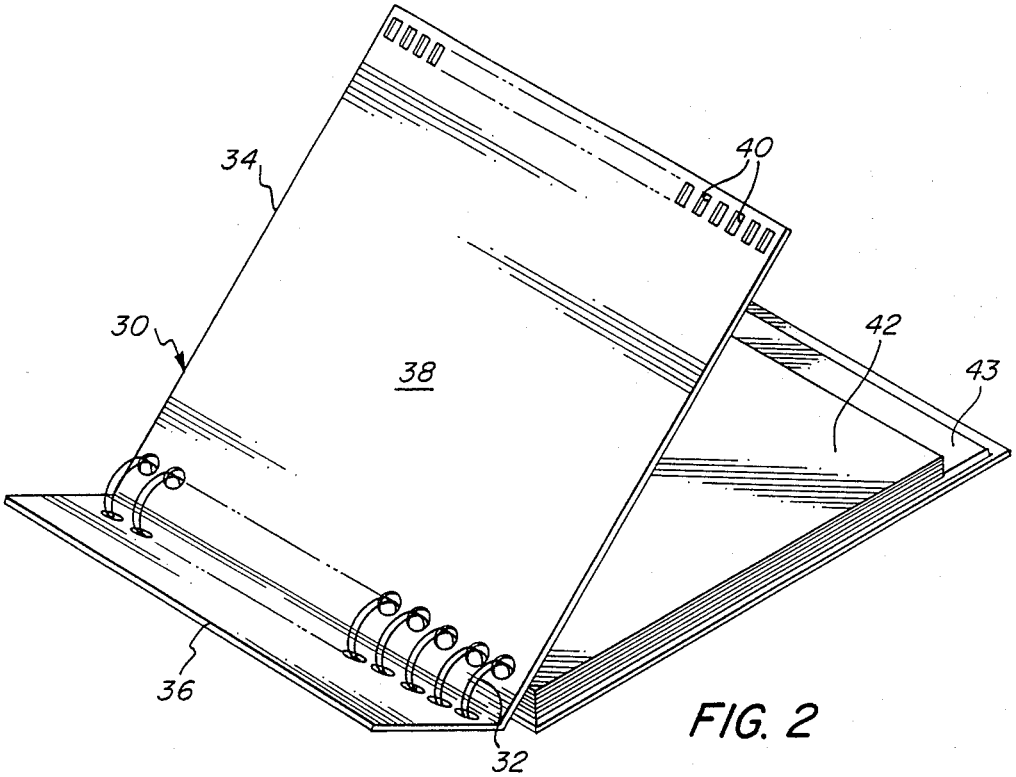
FIG. 2 is a perspective view of the removable insert utilized in the assembly of FIG. 1 with the mounting element pivoted upwardly.
Figures 3, 4:
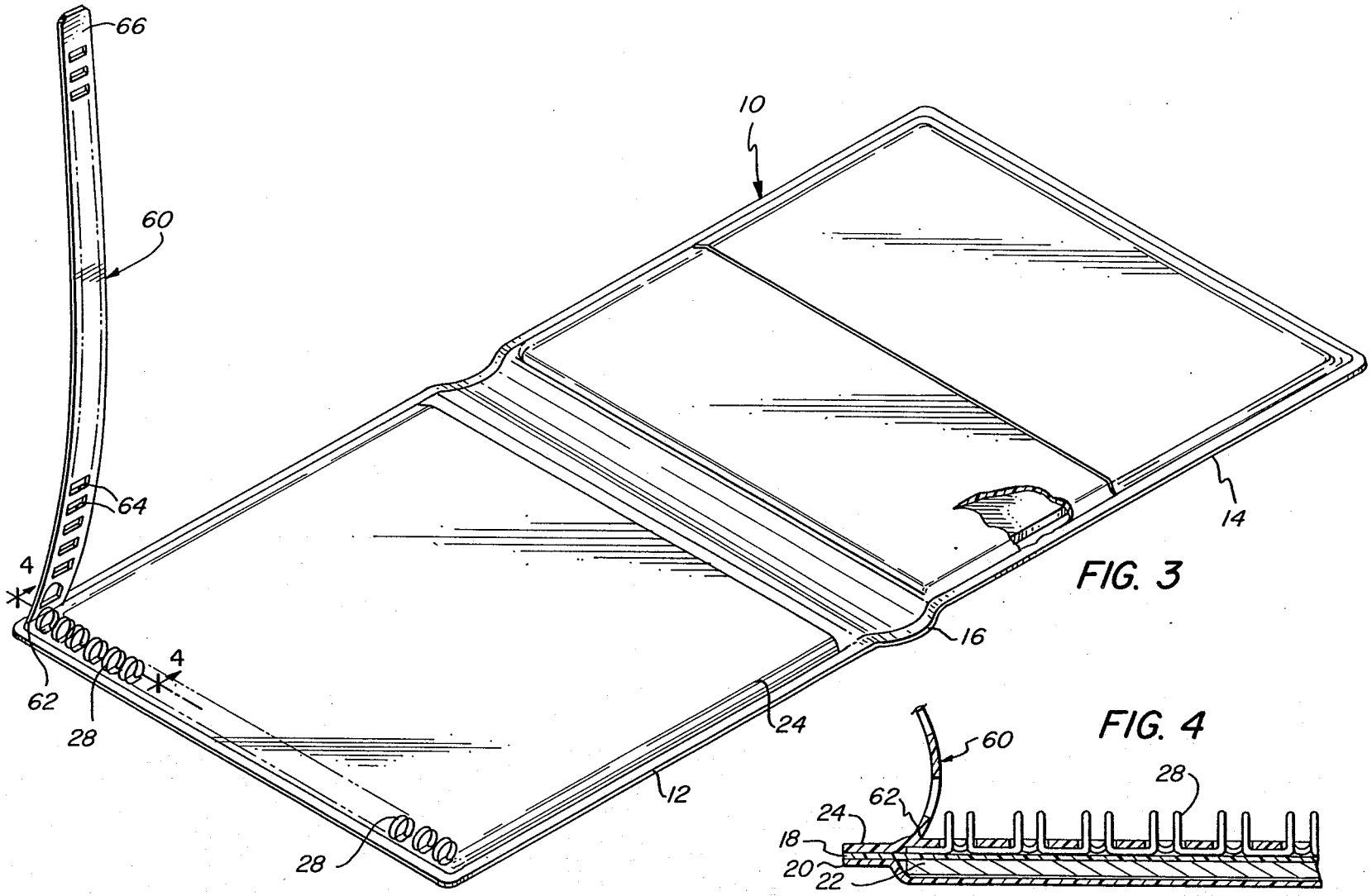
FIG. 3 is a perspective view of the fully opened binder of the assembly of FIG. 1 and showing the peel strip pivoted upwardly and a portion of the binder broken away to reveal internal construction.
FIG. 4 is a fragmentary sectional view along the line 4—4 of FIG. 3 drawn to an enlarged scale.

A locating member comprising a series of horizontally disposed rings 28 is formed of a continuous wire as seen in FIG. 4 and is spaced along the outer edge of the panel 12. The rings 28 extend upwardly through apertures in the top sheet 24.

A removable insert generally designated by the numeral 30 is securely seated in the cover 10 and has a series of spaced horizontally disposed rings 32 upon which is pivotably seated a mounting panel 34 of relatively stiff sheet material. The panel 34 is folded to provide a relatively short lower flap 36 which snugly seats in the pocket 26, and a relatively long upper flap 38 which extends across the top sheet 24 and which is provided with apertures 40 at its free end to seat snugly on the rings 28. Through this engagement of the flaps 36, 38 with the panel 12, the insert 30 is held in a predetermined position thereon.

Figure 5:
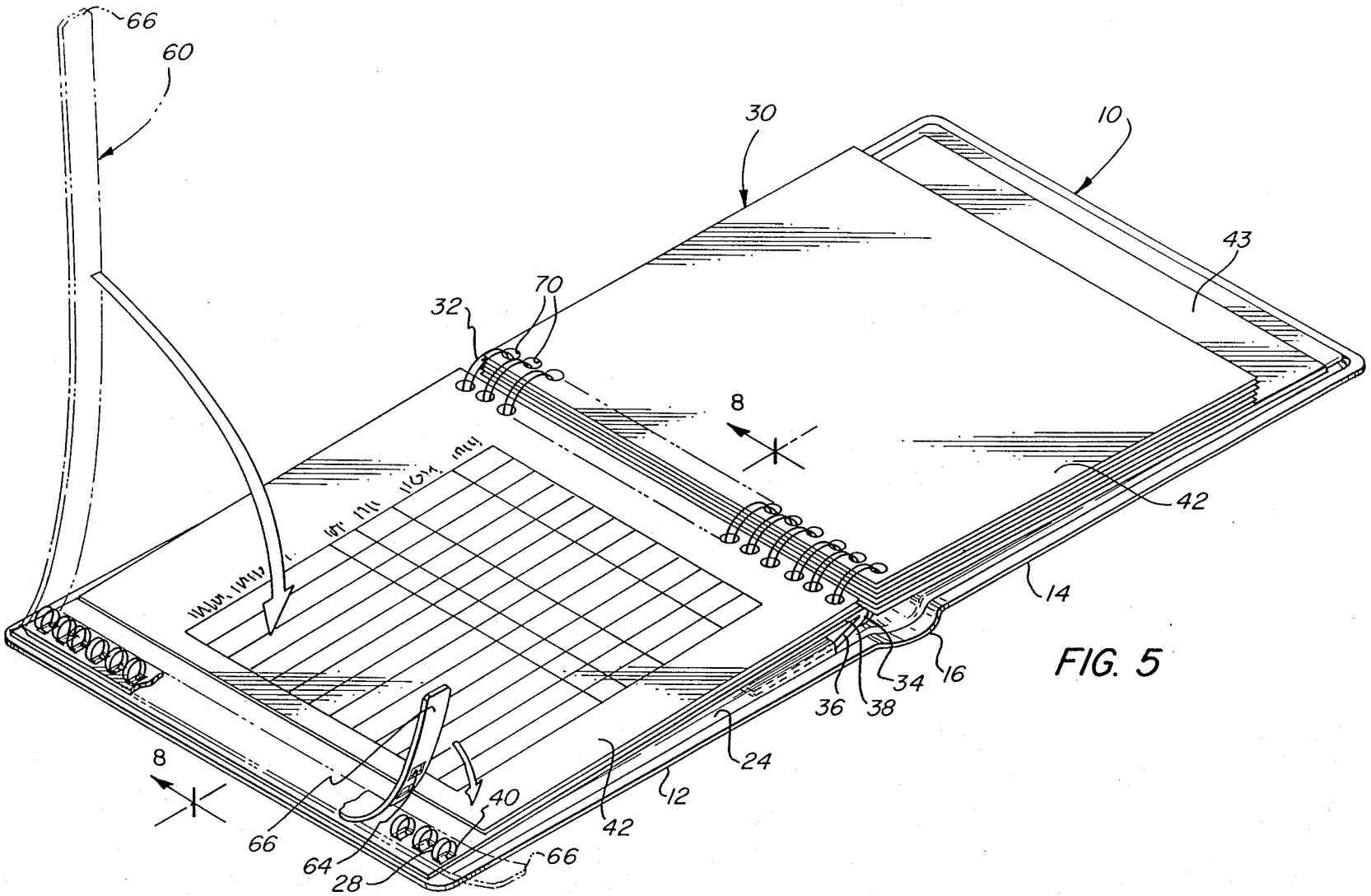
FIG. 5 is a perspective view of the assembly of FIG. 1 with the binder in the open position with the shingled assembly removed, and with the peel strip shown in full line as partially seated on the locating elements and in phantom line in the pivoted position and fully seated position.
Figure 7:
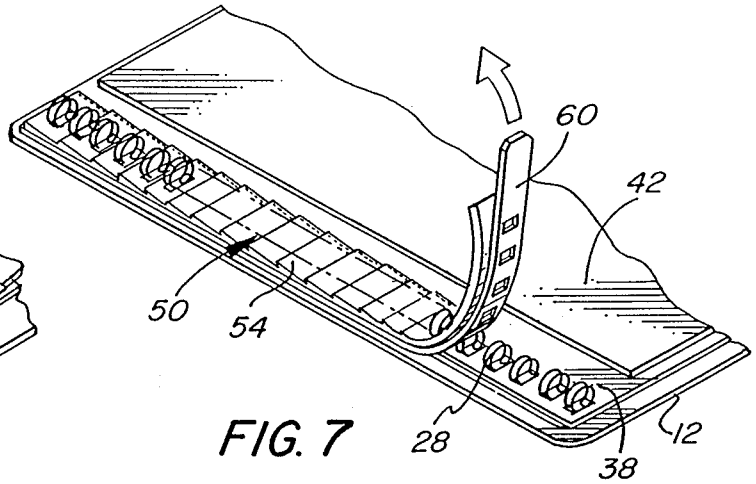
FIG. 7 is a fragmentary perspective view of the assembly in FIG. 6 with the peel strip being lifted to remove the skeleton of the shingled assembly.

Also pivotably mounted on the rings 32 are a series of recording or ledger sheets 42, one of which (42*a*) is shown in FIGS. 5 and 8 as pivoted into a position overlying the panel 12. As seen in FIG. 5 the sheets 42 are printed with column headings and with lines dividing a portion of the face thereof into rows and columns.

Figure 6:
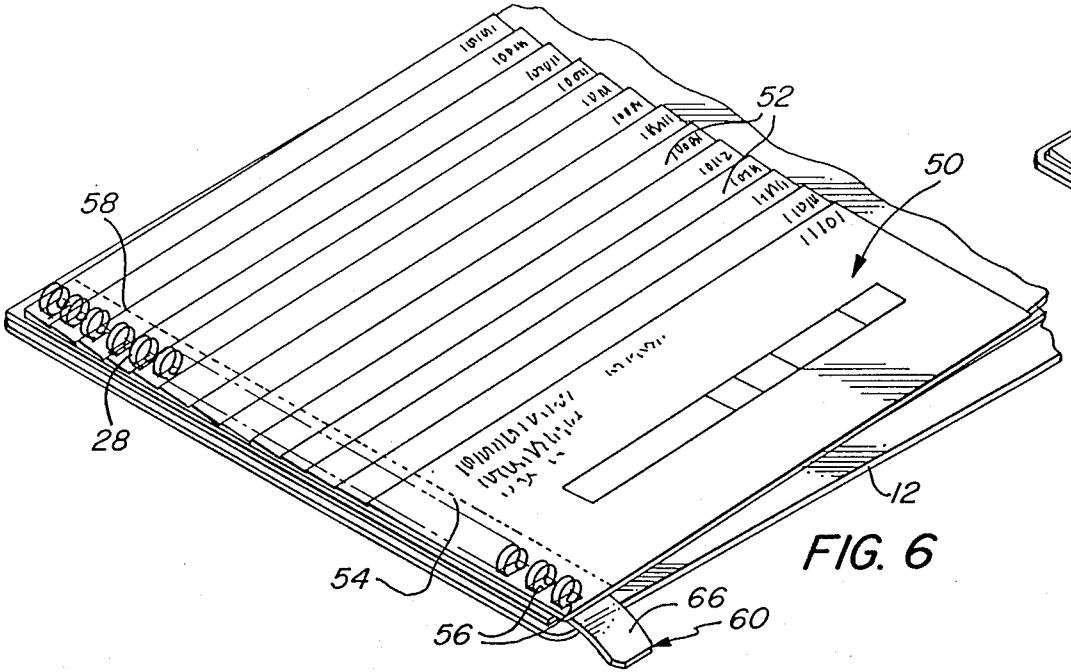
FIG. 6 is a fragmentary perspective view of the record keeping assembly in the open portion and with the shingled assembly in position.

Seated on the rings 28 is a shingled assembly generally designated by the numeral 50 and which is comprised of a series of overlapping elongated sheets 52 which are bonded together along their one side portion 54 and which are provided with apertures 56 in that side portion 54 to seat snugly on the rings 28. As seen in FIG. 6, the shingled sheets 52 are imprinted with indicia and with sections for entry of data which are aligned with the columns and rows of the recording sheets 42 for recordation of that data. Desirably, the shingled sheets 52 are perforated or scored adjacent the side portion 54 as indicated by the dotted line 58 so that they may be readily severed and removed while leaving the side portion 52 as a skeleton on the rings 28.

An elongated flexible peel strip generally designated by the numeral 60 has its one end portion 62 adhered to the panel 12 and is provided with a series of apertures 64 along its length so as to fit over the rings 28. In normal use, it is disposed between the upper flap 38 and the shingled assembly 50. Its length is sufficient for its free end portion 66 to project beyond the lower edge of the panel 12 so that this projecting portion may be readily gripped to pull upwardly thereon.

In preparing the assembly, a removable insert 30 is placed in a position overlying the panel 14 and the mounting panel 34 is pivoted to the position seen in FIG. 6. The insert 30 is then moved towards the panel 12 to slide the lower flap 36 into the pocket 26. The upper flap 38 is then pivoted downwardly to push the rings 28 through the apertures 40 therein. At this point the insert 30 is securely positioned on the cover 10 with its rings 32 disposed over the web or spine 16.

In use of the illustrated bookkeeping assembly, a fresh recording sheet 42 is pivoted into a position overlying the panel 12, and a fresh shingled assembly 50 of checks 52 or the like is mounted on the rings 28 over the peel strip 60. The checks 52 below the topmost are pivoted to expose the topmost check, and as that check is written, the name and amounts are entered on the check 52, the data is simultaneously recorded on the underlying recording sheet 42. The check 52 is then severed along the score line 58, and the next check 52 pivoted into recording position. To remove the remaining side portion or skeleton 54 of the peel strip 60 after all the checks 52 of the shingled assembly have been severed, the end portion 66 is gripped and lifted upwardly as seen in FIG. 6 to lift the apertured side portion 54 from the rings 28.

The binder or base member of the bookkeeping assembly may have a number of forms in addition to the two panel binder illustrated. For example, the present invention may be employed with a single panel pegboard or a three panel pegboard, one-write assembly of the types which are widely employed. Conveniently, synthetic resin sheet material provides the facing for the structure and rigid planar elements such as rigid plastic sheet or paperboard stock are encased therewithin as in the illustrated embodiment. The plastic sheet material covers offer an advantage in that they may be readily heat sealed about the rigidifying members and provide relatively durable surface.

The locating elements may be formed by a spiral continuous ring structure of the type illustrated, fabricated from metal or synthetic resin. However, separate rings or posts may be supported on a common planar base element which is then secured to the panel by adhesion or by mechanical fasteners.

The shingled assembly will normally comprise elongated elements such as checks, receipts, vouchers and the like with a row of perforations spaced along the one side edge thereof, and these perforations are cooperatively dimensioned and configured to snugly seat the locating elements of the binder. As previously indicated, the checks and like elements are generally scored adjacent the adhered marginal portion to provide a weakening line for severing them after they are written. This will leave a skeleton comprising the adhered marginal portion of the original shingled assembly.

The peel strip is conveniently fabricated from a flexible and relatively high tensile strength material such as leather or synthetic resin sheet material such as polyvinyl chloride. It may be bonded to the binder by heat sealing or adhesive or it may be secured by mechanical means such as riveting or stapling to the rigid planar member within the panel. The preferred peel strips are provided with perforation as indicated in the illustrated embodiment to allow the peel strip to be fitted directly over the locating elements and thereby to exert most effective lifting pressure on the skeleton of the shingled assembly disposed thereover. However, the peel strip may also extend along one side of the locating elements so long as it is closely adjacent thereto and the portion of the skeleton of the shingled assembly disposed thereover is sufficiently large and stiff to enable the peel strip to effectively lift the skeleton from the locating elements. Moreover, a pair of elongated strips located on opposite sides of the locating elements may be lifted as a single unit so that lifting pressure is placed upon the skeleton on both sides of the locating elements.

Thus, it can be seen from the foregoing detailed description and the accompanying drawings that the bookkeeping assembly of the present invention is one in which the shingled stack of checks or the like, or the skeleton remaining from such a shingled stack, may be readily removed from the locating elements of the assembly. The assembly may be fabricated relatively economically and easily from components which themselves are relatively economical, and the assembly is one which is easy to use and exhibits relatively long life.

Having thus described the invention, what is claimed is:

1. In a record keeping assembly, the combination comprising:

(a) a base member having a panel with a multiplicity of upstanding locating elements spaced in a row along the length of one side thereof;

(b) a shingled assembly having a series of overlapping elongated sheets each having a multiplicity of apertures adjacent one side thereof through which said locating elements extend, thereby mounting said shingled assembly on said base member with said sheets extending across said panel;

(c) a flexible peel strip having one end secured to said panel adjacent said one side and at one end of said row of locating elements, said peel strip extending across said panel adjacent said one side and below said sheets of said shingled assembly, the other end of said strip projecting beyond the other end of said row of locating elements and the adjacent edge of said panel, said peel strip being adapted to be gripped by said projecting other end and lifted upwardly to peel the portion of said sheets overlying said strip from said locating elements, said peel strip being adapted to bend and flex during said lifting and peeling.

2. The record keeping assembly of claim 1 wherein said peel strip has spaced apertures therein through which said locating elements extend.

3. The record keeping assembly of claim 1 wherein said peel strip is fabricated from a flexible synthetic resin sheet material.

4. The record keeping assembly of claim 1 wherein said base member has at least two panels hingedly connected along the opposite side of said first mentioned panel.

5. The record keeping assembly of claim 1 wherein said assembly additionally includes at least one record keeping page underlying said shingled assembly and onto which some of the data being recorded on said sheets of said shingled assembly is simultaneously recorded.

6. The record keeping assembly of claim 1 wherein said one end of said peel strip is adhered to said one panel.

7. The record keeping assembly of claim 1 wherein said locating elements comprise horizontally oriented rings.

8. The record keeping assembly of claim 1 wherein said sheets of said shingled assembly comprise checks.

9. In a record keeping assembly, the combination comprising:

(a) a base member having a panel with a multiplicity of upstanding locating elements spaced in a row along the length of one side thereof, said locating elements comprising horizontally oriented rings;

(b) a shingled assembly having a series of overlapping elongated sheets, each having a multiplicity of apertures adjacent one side thereof through which said locating elements extend, thereby mounting said shingled assembly on said base member with said sheets extending across said panel;

(c) a flexible peel strip fabricated from a flexible synthetic resin sheet material having one end secured to said panel adjacent said one side and at one end of said row of the locating elements, said peel strip extending across said panel adjacent said one side and below said sheet of said shingled assembly, said peel strip having spaced apertures therein through which said locating elements extend, the other end of said strip projecting beyond the other end of said row of locating elements and the adjacent edge of said panel, said peel strip being adapted to be gripped by said projecting other end and lifted upwardly to peel the portion of said sheet overlying said strip from said locating elements, said peel strip being adapted to bend and flex during said lifting and peeling.

10. The record keeping assembly of claim 9 wherein said base member has at least two panels hingedly connected along the opposite side of said first mentioned panel.

11. The record keeping assembly of claim 9 wherein said assembly additionally includes at least one record keeping page underlying said shingled assembly and onto which some of the data being recorded on said sheets of said shingled assembly is simultaneously recorded.

12. The record keeping assembly of claim 9 wherein said sheets of said shingled assembly comprise checks.

* * * * *